US008902038B2

(12) United States Patent
Ueda et al.

(10) Patent No.: US 8,902,038 B2
(45) **Date of Patent: *Dec. 2, 2014**

(54) THERMALLY RESPONSIVE SWITCH

(75) Inventors: Yoshihisa Ueda, Nagoya (JP); Takeo Koike, Nagoya (JP); Mitsuhiro Urano, Nagoya (JP); Shigemi Sato, Nagoya (JP)

(73) Assignee: Ubukata Industries Co., Ltd., Nagoya-Shi, Aichi (JP)

( * ) Notice: Subject to any disclaimer, the term of this patent is extended or adjusted under 35 U.S.C. 154(b) by 646 days.

This patent is subject to a terminal disclaimer.

(21) Appl. No.: 12/376,291

(22) PCT Filed: Aug. 8, 2007

(86) PCT No.: PCT/JP2007/065552

§ 371 (c)(1),
(2), (4) Date: Feb. 3, 2009

(87) PCT Pub. No.: WO2008/018516

PCT Pub. Date: Feb. 14, 2008

(65) Prior Publication Data

US 2009/0315666 A1 Dec. 24, 2009

(30) Foreign Application Priority Data

Aug. 10, 2006 (WO) ..... PCT/JP2006/315852

(51) Int. Cl.

| | |
|---|---|
| ***H01H 37/00*** | (2006.01) |
| ***H01H 37/64*** | (2006.01) |
| ***H01H 37/54*** | (2006.01) |
| ***H01H 37/36*** | (2006.01) |
| ***H01H 1/0237*** | (2006.01) |
| *H01H 50/02* | (2006.01) |

(52) U.S. Cl.

CPC ..... *H01H 37/5427* (2013.01); *H01H 2050/025* (2013.01); *H01H 1/02372* (2013.01)

USPC ..... 337/298; 337/329; 337/362; 337/365; 337/326

(58) Field of Classification Search

USPC ..... 337/298, 329, 362, 365, 326

See application file for complete search history.

(56) References Cited

U.S. PATENT DOCUMENTS 2,239,540 A 4/1941 Spencer
2,280,550 A * 4/1942 Smitley ..... 337/27

(Continued)

FOREIGN PATENT DOCUMENTS

GB 2080039 A 1/1982
JP S54-103570 A 8/1979

(Continued)

OTHER PUBLICATIONS

Office Action in corresponding KR Application No. 10-2009-7004176, dated Dec. 20, 2010.

(Continued)

*Primary Examiner* — Bradley Thomas

(74) *Attorney, Agent, or Firm* — Thomas, Karceski & Karmilovich, PC

(57) ABSTRACT

A thermally responsive switch includes a container including a metal housing and a header plate, at least one conductive terminal pin inserted through a hole of the header plate, a fixed contact fixed to the terminal pin, a thermally responsive plate having one of two ends conductively connected via a support to an inner surface of the container and reversing a direction of curvature at a predetermined temperature, and at least one movable contact electrically conductively secured directly to the other end of the thermally responsive plate. Each contact is comprised of a silver-cadmium oxide system contact. The container is filled with a gas containing helium ranging from 50% to 95% so that an internal pressure of the container ranges from 0.38 atmosphere to 0.68 atmosphere at room temperature such that arc generated during opening of the contacts moves on surfaces of the contacts without spreading from the contacts.

18 Claims, 8 Drawing Sheets

(56) References Cited

U.S. PATENT DOCUMENTS

| | | | | | |
|---|---|---|---|---|---|
| 2,284,103 | A | * | 5/1942 | Smitley | 337/27 |
| 2,667,553 | A | * | 1/1954 | Moorhead et al. | 337/365 |
| 3,140,370 | A | * | 7/1964 | Harper, Jr. | 337/86 |
| 3,278,706 | A | | 10/1966 | Robidoux | |
| 4,050,930 | A | * | 9/1977 | Motoyoshi et al. | 148/431 |
| 4,072,515 | A | * | 2/1978 | Motoyoshi et al. | 148/431 |
| 4,114,127 | A | * | 9/1978 | Pejouhy | 337/97 |
| 4,167,721 | A | * | 9/1979 | Senor et al. | 337/112 |
| 4,287,499 | A | * | 9/1981 | Pejouhy | 337/97 |
| 4,374,311 | A | * | 2/1983 | Okahashi et al. | 200/269 |
| 4,376,926 | A | * | 3/1983 | Senor | 337/104 |
| 4,426,560 | A | | 1/1984 | Kimblin | |
| 4,476,452 | A | * | 10/1984 | D'Entremont | 337/102 |
| 4,555,686 | A | * | 11/1985 | Pejouhy et al. | 337/102 |
| 4,594,489 | A | * | 6/1986 | Gengenbach et al. | 218/117 |
| 4,789,762 | A | * | 12/1988 | Miller et al. | 200/61.45 R |
| 4,843,363 | A | * | 6/1989 | Ubukata et al. | 337/94 |
| 4,846,901 | A | * | 7/1989 | Lima et al. | 148/678 |
| 5,107,241 | A | * | 4/1992 | Ubukata et al. | 337/368 |
| 5,121,095 | A | * | 6/1992 | Ubukata et al. | 337/365 |
| 5,212,465 | A | * | 5/1993 | Mizutani et al. | 337/368 |
| 5,221,914 | A | * | 6/1993 | Ubukata et al. | 337/13 |
| 5,483,216 | A | * | 1/1996 | Mizutani et al. | 337/370 |
| 5,600,109 | A | * | 2/1997 | Mizutani et al. | 200/61.45 R |
| 5,607,522 | A | * | 3/1997 | McDonnell | 148/281 |
| 5,825,278 | A | * | 10/1998 | Reid et al. | 337/407 |
| 5,837,951 | A | * | 11/1998 | Kato et al. | 200/61.45 R |
| 5,939,970 | A | * | 8/1999 | Tsuji et al. | 337/343 |
| 6,084,193 | A | | 7/2000 | Pellon | |
| 6,154,117 | A | * | 11/2000 | Sato et al. | 337/365 |
| 6,674,620 | B2 | * | 1/2004 | Lamborghini et al. | 361/26 |
| 2003/0057073 | A1 | * | 3/2003 | Smith | 200/262 |
| 2003/0057849 | A1 | * | 3/2003 | Pruett et al. | 315/119 |
| 2003/0102954 | A1 | * | 6/2003 | Herrick | 337/102 |
| 2003/0184928 | A1 | * | 10/2003 | Mori et al. | 361/6 |
| 2004/0023253 | A1 | * | 2/2004 | Kunwar et al. | 435/6 |
| 2004/0154907 | A1 | * | 8/2004 | Blossfeld et al. | 200/11 R |
| 2004/0263311 | A1 | * | 12/2004 | Scott et al. | 337/36 |
| 2005/0264393 | A1 | * | 12/2005 | Yamada | 337/85 |
| 2009/0302989 | A1 | | 12/2009 | Ueda et al. | |

FOREIGN PATENT DOCUMENTS

| | | | |
|---|---|---|---|
| JP | 62-259326 | | 11/1987 |
| JP | 02-227928 | | 9/1990 |
| JP | 08-161954 | | 6/1996 |
| JP | 10-144189 | | 5/1998 |
| JP | 2002-352685 | | 12/2002 |
| JP | 2003-059379 | | 2/2003 |
| JP | 2003338238 | A | 11/2003 |
| JP | 2004332593 | A | 11/2004 |
| JP | 2005-268058 | | 9/2005 |
| JP | 2005240596 | A | 9/2005 |
| JP | 2006-031955 | A | 2/2006 |

OTHER PUBLICATIONS

Office Action dated May 7, 2012, in corresponding Canadian Patent Application No. CA 2,660,140.

Search Report, dated May 18, 2012, in corresponding European Patent Application No. EP 07792219.3.

Office Action dated May 21, 2013, in corresonding Canadian Patent Application No. CA 2,660,140.

Office Action dated Jan. 21, 2014, in corresonding Canadian Patent Application No. CA 2,660,140.

English Abstract for JP 2-519530, which corresponds to JP 2-0227928, listed above.

* cited by examiner 0. 5 atm.

A − 1

B − 1

0. 7 atm.

A − 2

B − 2

1. 0 atm.

A − 3

B − 3

1. 3 atm.

A − 4

B − 4

THERMALLY RESPONSIVE SWITCH

CROSS-REFERENCE TO RELATED APPLICATION(S)

This U.S. Non-Provisional Patent Application is a National Stage Patent Application that relies for priority on International Patent Application No. PCT/JP2007/65552, filed on Aug. 8, 2007, and on PCT/JP2006/315852, filed on Aug. 10, 2006.

BACKGROUND

1. Field

The present invention relates to a thermally responsive switch having a contact switching mechanism using a thermally responsive plate such as a bimetal in a hermetic container.

2. Related Art

Thermally responsive switches of this type are disclosed in Japanese patent No. 2519530 (prior art document 1) and Japanese patent application publications JP-A-H10-144189 (prior art document 2), JP-A-2002-352685 (prior art document 3) and JP-A-2003-59379 (prior art document 4). The thermally responsive switch described in each document comprises a thermally responsive plate provided in a hermetic container comprising a metal housing and a header plate. The thermally responsive plate reverses a direction of curvature thereof at a predetermined temperature. An electrically conductive terminal pin is inserted through the header plate and hermetically fixed by an electrically insulating filler such as glass. A fixed contact is attached directly or via a support to a distal end of the terminal pin located in the hermetic container. Furthermore, the thermally responsive plate has one end fixed via a support to an inner surface of the hermetic container and the other end to which a movable contact is secured. The movable contact constitutes a switching contact with the fixed contact.

The thermally responsive switch is mounted in a closed housing of a hermetic electric compressor thereby to be used as a thermal protector for an electric motor of the compressor. In this case, windings of the motor are connected to the terminal pin or the header plate. The thermally responsive plate reverses the direction of curvature when a temperature around the thermally responsive switch becomes unusually high or when an abnormal current flows in the motor. When the temperature drops to or below a predetermined value, the contacts are re-closed such that the compressor motor is energized.

The thermally responsive switch is required to open the contacts upon every occurrence of the aforesaid abnormal condition until a refrigerating machine or air conditioner in which the compressor is built reaches an end of product's life. The thermally responsive switch needs to cut off current extremely larger than a rated current of the motor particularly when a motor is driven in a locked rotor condition or when a short occurs between motor windings. When current having such a large inductivity is cut off by the opening of contacts, arc is generated between the contacts, whereupon contact surfaces are damaged by heat due to arc. The welding of contacts occurs when the switching of contacts exceeds a guaranteed operation number. In this regard, in order that an electric path may be cut off even upon occurrence of contact welding for the purpose of preventing secondary abnormality, double safety and protective measures are taken when needed (a fusing portion of a heater described in prior art documents 1 and 2, for example).

In order that a guaranteed operation number of times of the contact switching may be improved, a structure is considered in which the size of the contacts is increased for the purpose of increasing the heat capacity, whereby occurrence of contact welding is reduced even upon occurrence of arc. Furthermore, another structure is considered in which the size of the thermal responsive plate is increased so that a force separating the contacts from each other is increased. However, when either construction is employed, the thermally responsive switch would be rendered larger in size, whereupon it would become difficult to mount the thermally responsive switch in the hermetic housing of the compressor. Additionally, the thermally responsive switch is desired to be applied to motors for compressors with large heat capacity while the size of the thermally responsive switch is reduced.

SUMMARY

An object of the present invention is to provide a thermally responsive switch which is small in size and has a high durability and current cutoff performance.

The present invention provides a thermally responsive switch which is used to cut off AC current flowing through a compressor motor, the thermally responsive switch comprising a hermetically sealed container including a metal housing and a header plate hermetically secured to an open end of the housing, at least one conductive terminal pin inserted through a through hole formed through the header plate and hermetically fixed in the through hole by an electrically insulating filler, a fixed contact fixed to the terminal pin in the container, a thermally responsive plate having one of two ends conductively connected and fixed via a support made of a metal plate to an inner surface of the container and formed into a dish shape by drawing so as to reverse a direction of curvature at a predetermined temperature, at least one movable contact electrically conductively secured directly to the other end of the thermally responsive plate and constituting at least one pair of switching contacts together with the fixed contact, wherein each of the fixed contact and the movable contact comprises a silver-cadmium oxide system contact, and the container is filled with a gas containing helium ranging from 50% to 95% so that an internal pressure of the container ranges from 0.38 atmosphere to 0.68 atmosphere at room temperature.

According to the invention, the thermally responsive switch is resistant to local damage due to arc since the arc generated by the opening of the contacts moves on each contact. Consequently, the thermally responsive switch has an improved durability and can achieve a high current cutoff performance even though the thermally responsive switch has a smaller size.

DETAILED DESCRIPTION

Figure 1:
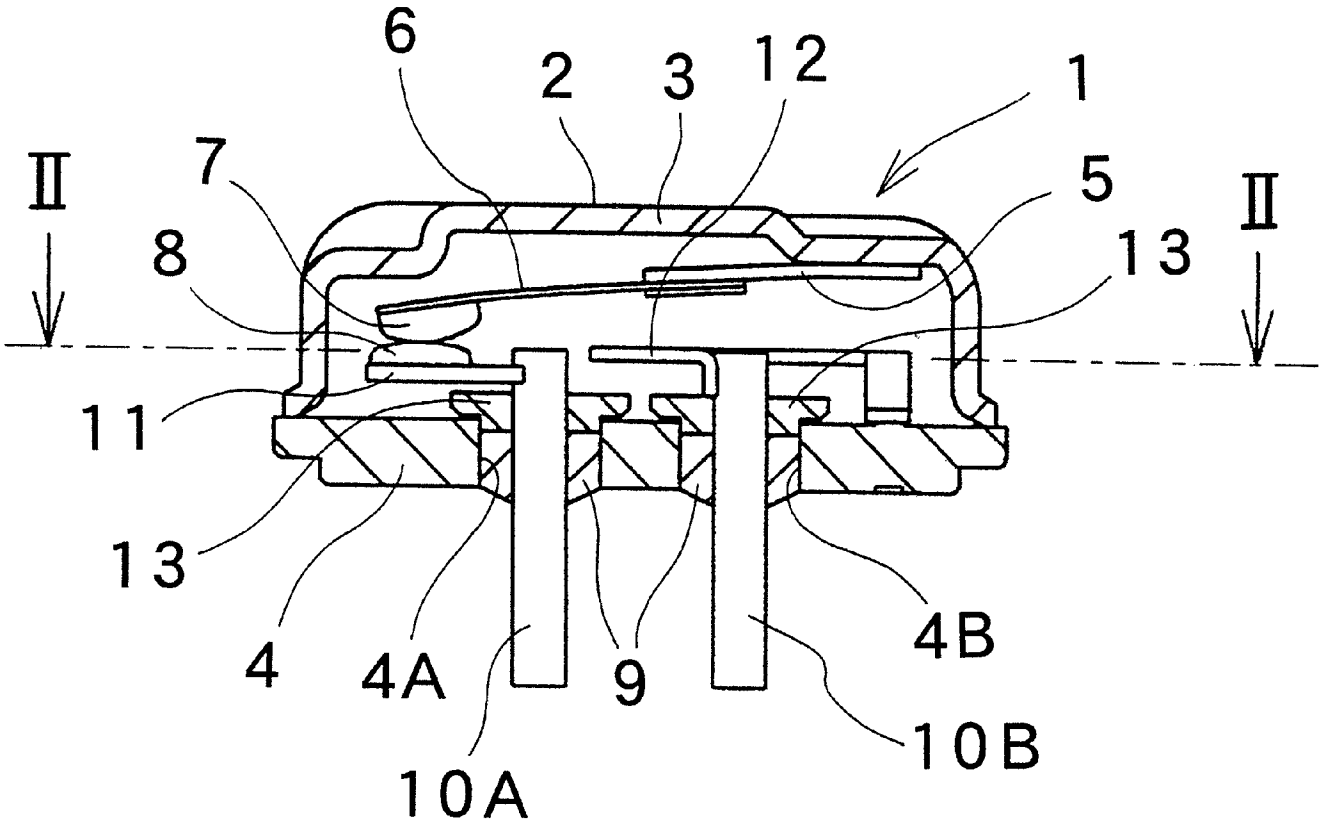
FIG. 1 is a longitudinal section of a thermally responsive switch of one embodiment in accordance with the present invention.
Figure 2:
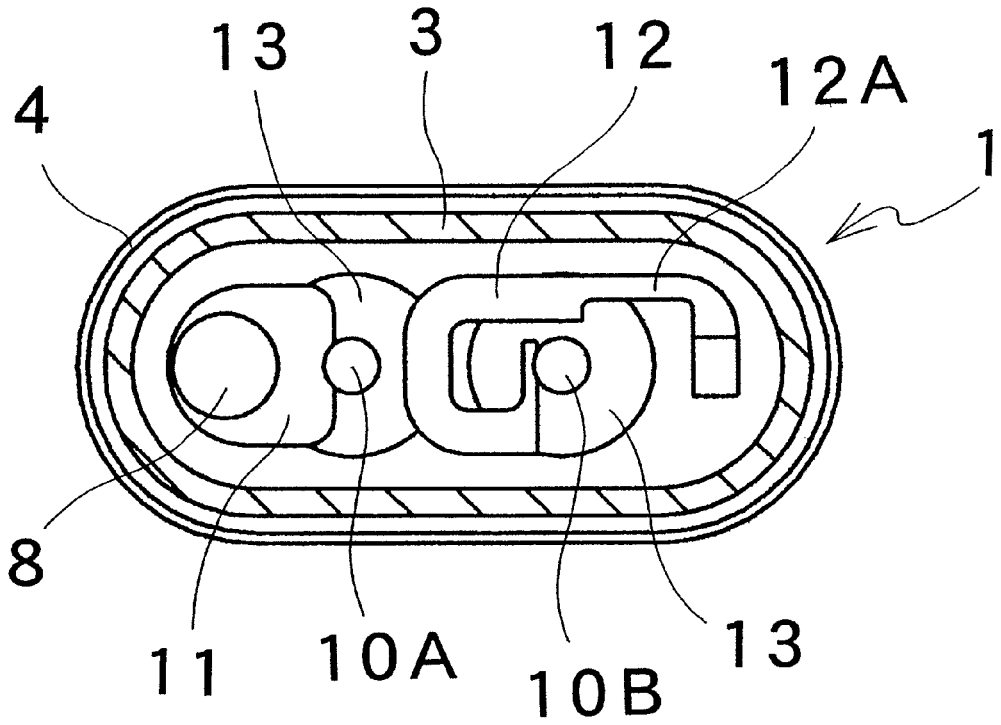
FIG. 2 is a cross section taken along line II-II in FIG. 1.
Figure 3:
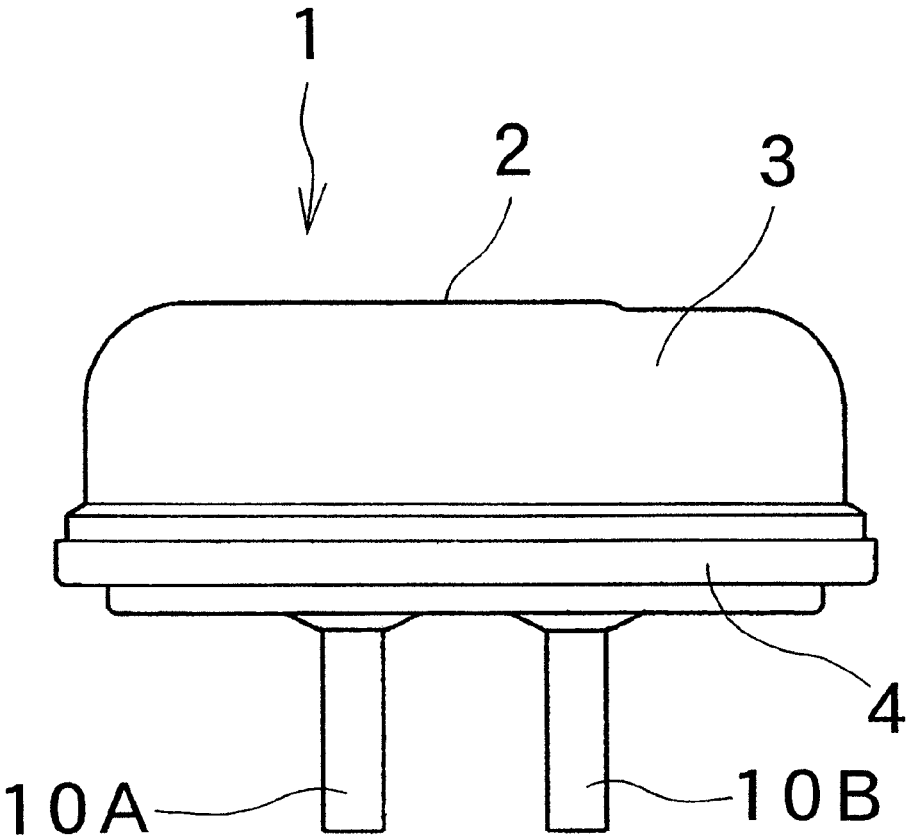
FIG. 3 is a side view of the thermally responsive switch.
Figure 4:
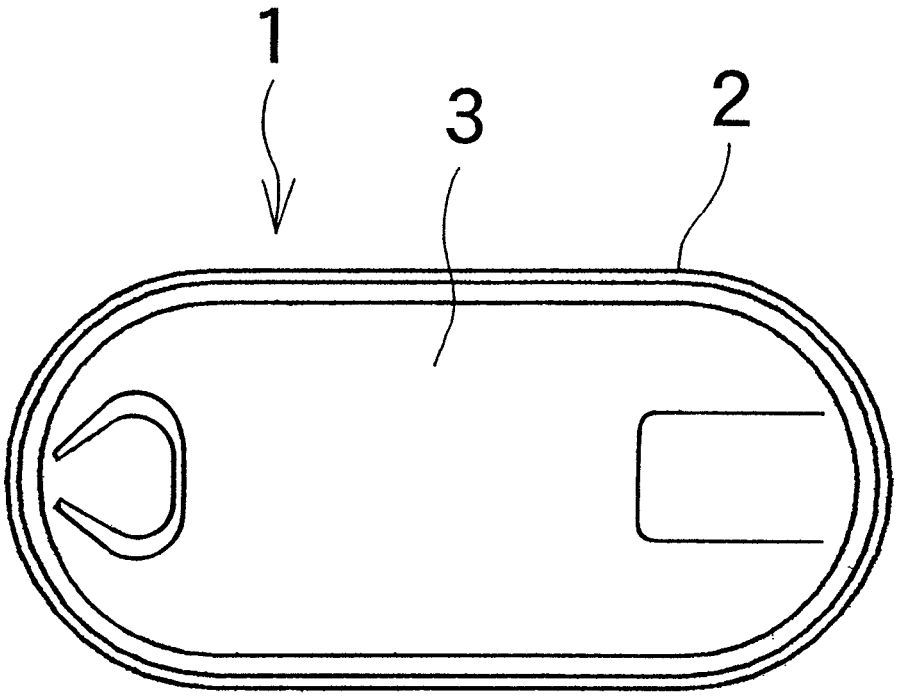
FIG. 4 is a plan view of the thermally responsive switch.

One embodiment will be described with reference to the drawings. The present invention is applied to a thermal protector for an electric motor of a compressor in the embodiment. FIGS. 3 and 4 are side and plan views of a thermally responsive switch respectively, FIG. 1 is a longitudinal section thereof, and FIG. 2 is a cross section taken along line II-II in FIG. 1. The thermally responsive switch 1 comprises a hermetically sealed container 2 including a metal housing 3 and a header plate 4. The housing 3 is formed into an elongate dome shape by drawing an iron plate or the like by a press machine so as to have both lengthwise ends each formed into a substantially spherical shape and a middle portion connecting the ends. The header plate 4 is formed by shaping an iron plate thicker than the housing 3 into an oval and is hermetically sealed to an open end of the housing 3 by the ring projection welding or the like.

A thermally responsive plate 6 has one end fixed via a support 5 made of a metal plate to an inside of the container 2. The thermally responsive plate 6 is formed by drawing a thermally responsive member such as a bimetal or trimetal into a shallow dish shape and is designed to reverse a direction of curvature with a snap action when the thermally responsive member reaches a predetermined temperature. A movable contact 7 is secured to the other end of the thermally responsive plate 6. A part of the container 2 to which the support 5 is fixed is externally collapsed thereby to be deformed, so that a contact pressure is adjustable between the fixed contact 7 and a movable contact 8 which will be described later, whereupon a temperature at which the thermally responsive plate 6 reverses the direction of curvature can be calibrated to a predetermined value.

The header plate 4 has two through holes 4A and 4B through which electrically conductive terminal pins 10A and 10B are inserted and hermetically fixed in the through holes by an electrically insulating filler 9 such as glass or the like in view of a thermal expansion coefficient by a well-known hermetic compression sealing. A contact support 11 is secured to a part of the terminal pin 10A near to the distal end of the pin inside the housing 3. The fixed contact 8 is secured to a part of the contact support 11 opposed to the movable contact 7.

Each of the movable and fixed contacts 7 and 8 comprises a silver-cadmium oxide (Ag—CdO) system contact containing a predetermined percentage of cadmium oxide (for example, 5 to 15 weight percentage). Each contact 7 or 8 is formed into a three layer structure including an intermediate layer of copper and a lower layer of iron together with the silver-cadmium oxide. Each contact has the shape of a disc having a diameter ranging from 3 mm to 5 mm and a slightly convexly curved surface (a sphere having a radius of 8 mm in the embodiment, for example).

A heater 12 serving as a heating element has one of two ends fixed to a portion of the terminal pin 10B located near the distal end of the terminal pin inside the hermetically sealed container 2. The other end of the heater 12 is fixed to the header plate 4. The heater 12 is disposed so as to be substantially parallel to the thermally responsive plate 6 along the terminal pin 10B, so that heat generated by the heater 12 is efficiently transmitted to the thermally responsive plate 6.

The heater 12 is provided with a fusing portion 12A having a smaller sectional area than the other part thereof. The fusing portion 12A is prevented from being fused by an operating current of an electric motor during a normal operation of a compressor serving as an equipment to be controlled. Furthermore, the fusing portion 12A is further prevented from being fused upon occurrence of a locked rotor condition of the motor since the thermally responsive plate 6 reverses its direction of curvature thereby to open the contacts 7 and 8 in a short period of time. However, when the thermally responsive switch 1 repeats the opening and closure of the contacts for a long period of time such that the number of times of switching exceeds a guaranteed number of switching operations, the movable and fixed contacts 7 and 8 are sometimes welded together thereby to be inseparable from each other. In this case, when a rotor of the motor is locked, a temperature of the fusing portion 12A is increased by an excessively large current such that the fusing portion is fused, whereupon power supply to the motor can reliably be cut off.

The container 2 is filled with a gas containing helium (He) ranging from 50% to 95% so that an internal pressure of the container 2 ranges from 0.38 atm. to 0.68 atm. at room temperature, as will be described later. The gas filling the container 2 contains nitrogen, dried air, carbon dioxide and the like other than helium. The container 2 is filled with helium as an inert gas for the following reason. That is, helium has such a good heat conductivity that upon occurrence of an excessively large current, a period of time (short time trip (S/T)) necessitated for the opening of the contacts 7 and 8 by heat generated by the heater 12 can be shortened as described in prior art document 2. Furthermore, a minimum operating current value (an ultimate trip current (UTC)) can be increased as compared with the conventional thermal protectors. Additionally, when the thermally responsive plate 6 is configured so that its resistance value is increased for the purpose of increasing a heating value thereof, heat generated by the plate 6 as the result of the filling of the container 2 with helium can efficiently be allowed to escape. Consequently, the aforesaid short time trip (S/T) can be rendered longer. However, since the breakdown voltage tends to be reduced when a helium charged rate is increased, the helium charged rate preferably ranges from 30% to 95% or particularly from 50% to 95% in the case of an ordinary commercial power supply ranging from AC 100 V to 260 V.

On the filler 9 fixing the terminal pins 10A and 10B is closely fixed a heat-resistant inorganic insulating member 13 comprising ceramics and zirconia (zirconium oxide). The heat-resistant inorganic insulating member 13 is configured in consideration of the physical strength such as resistance to a creeping discharge or resistance to heat due to sputter. Consequently, even when sputter occurring during meltdown by the heater 12 is adhered to the surface of the heat-resistant inorganic insulating member 13, a sufficient insulating performance can be maintained, whereupon arc generated between fusing portions can be prevented from transition to a space between the terminal pin 10B and the header plate 4 or a space between the terminal pins 10A and 10B.

When current flowing into the motor is a normal operation current including a short-duration starting current, the contacts 7 and 8 of the thermally responsive switch 1 remain closed, so that the motor continues running. On the other hand, the thermally responsive plate 6 reverses the direction of curvature thereof to open the contacts 7 and 8, thereby cutting off the motor current when a current larger than a normal current flows continuously into the motor as the result of an increase in the load applied to the motor, the motor is constrained such that an extremely large constraint current flows into the motor continuously for more than several seconds, or when the temperature of a refrigerant in the hermetic housing of the compressor becomes extremely high. Subsequently, when the internal temperature of the thermally responsive switch 1 drops, the thermally responsive plate 6 again reverses the direction of curvature thereof such that the contacts 7 and 8 are closed, whereupon energization to the motor is re-started.

Next, the following describes optimization of the structure of the thermally responsive switch 1 based on the durability test. The thermally responsive switch 1 used as a thermal protector for the compressor motor necessitates the performance of cutting off an extremely large current such as constraint current flowing in the event of locked rotor condition or a short-circuit current flowing in the occurrence of a short circuit between the windings of the motor. Furthermore, the thermally responsive switch 1 necessitates a durability longer than a product's life of a refrigerating machine or an air conditioner in which the compressor to be protected is built. Additionally, the thermally responsive switch 1 needs to be small in size from the viewpoints of installation space and thermal responsiveness since the switch 1 is used in the hermetic housing of the enclosed electric compressor.

Arc is generated between the contacts 7 and 8 when the contacts 7 and 8 are opened while an excessively large inductive current such as the aforesaid constraint current or short-circuit current is flowing. In order that the durability (the guaranteed operation number) and current cutoff performance of the thermally responsive switch 1 may be improved, it is effective to shorten an arc-extinguishing time or to reduce damage due to arc. Damage due to arc sometimes spreads not only to the contacts 7 and 8 but also outside the contacts, for example, to the thermally responsive plate 6.

Known means for reducing the arc-extinguishing time include high pressurization or extremely low pressurization of filling gas (vacuuming), an increase in the intercontact gap, the mounting of an arcing horn, magnetic induction of arc and arc blowout. However, these means result in significant reduction in the production efficiency, complicated structure and an increase in the size of the thermally responsive switch 1. Accordingly, the means are unsuitable for the thermally responsive switches protecting relatively smaller motors used in compressors.

The thermally responsive switch 1 of the embodiment is directed to protection of AC motors driven by a commercial power supply. Arc has a duration of ten and several ms (a half cycle) at the longest and of several ms on average. Then, the durability test was conducted so that high durability and high current cutoff performance can be achieved by reducing damage due to arc as much as possible but not by reducing the arc-extinguishing time. The structural optimization was carried out based on the results of the durability test.

In the durability test, an upper part of the hermetic housing of the compressor in which the motor is built is cut, and the thermally responsive switch 1 was mounted in the compressor. Subsequently, the compressor was installed on a test bench, and the thermally responsive switch 1 repeated a switching operation under the condition that an excessively large current flowed into the motor.

The motor was a single-phase induction motor having a rated voltage of 220 V (50 Hz), rated current of 10.8 A and rated power of 2320 W. A rotor of the motor was held so as to be prevented from rotation. A power supply under test was 240 V 50 Hz. The compressor was installed under the circumstance of room temperature (25° C.). A constraint current at the start of the durability test (when the temperature of the motor was at room temperature) had the value of 60 A. The temperature of the motor rose as the result of repeated energization and de-energization, achieving equilibrium at the constraint current of 49 A. The thermally responsive switch 1 used in the durability test had the minimum operating current (UTC) ranging from 17 A to 24 A (120° C.) and had a characteristic that the contacts 7 and 8 were opened in 3 to 10 seconds (S/T) upon flow of 54 A current.

A constraint current of an electric motor is several times larger than a rated current, and a period of time (S/T) necessary for opening the contacts 7 and 8 is shortened to about several seconds by the heating of the motor, the heater 12 in the thermally responsive switch 1 and the thermally responsive plate 6 as described above. Upon opening of the contacts 7 and 8, an interior temperature of the thermally responsive switch 1 gradually drops such that the contacts 7 and 8 are re-closed in about 2 minutes, whereby the motor is energized. The number of normally repeated switching operations was measured in the durability test. In each switching operation, energization by the constraint current (for several seconds) as the result of closing operation of the thermally responsive switch 1 and de-energization (about 2 minutes) as the result of an opening operation of the thermally responsive switch 1.

When the contacts 7 and 8 are repeatedly opened and closed during the flowing of a locked-rotor current, the contacts 7 and 8 are gradually damaged by arc generated during contact opening, whereupon the contact welding occurs. In the durability test, when an energizing time exceeded 10 seconds (S/T), it was determined that the contact welding had occurred and the test was terminated. It was observed that the thermally responsive plate 6 was damaged by the arc depending upon the intercontact distance. Furthermore, since the thermally responsive plate 6 repeated reversing the direction of curvature with snap action every time of switching, the thermally responsive plate 6 was sometimes broken by fatigue before occurrence of contact welding when the switching number became excessively large.

Figure 5:
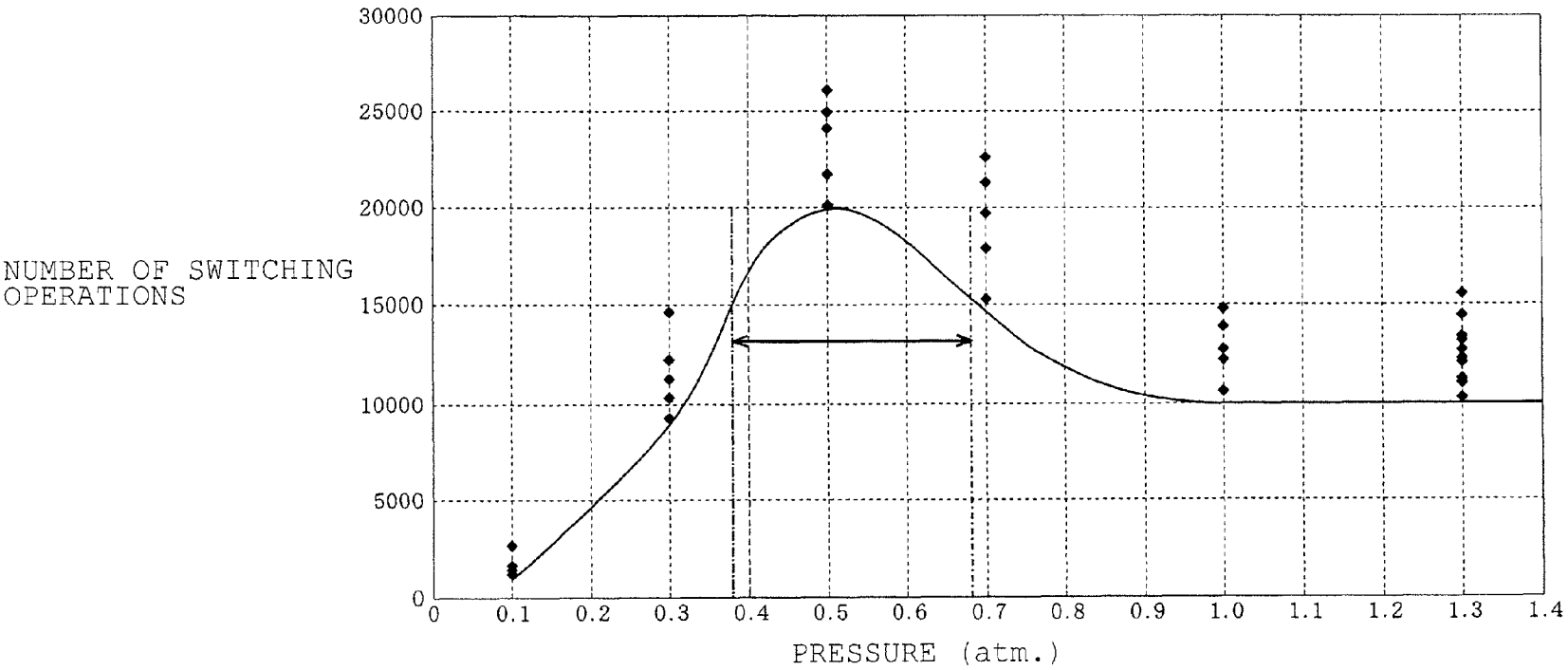
FIG. 5 is a graph showing results of a durability test in the case where a gas charged pressure is varied.
Figure 6:
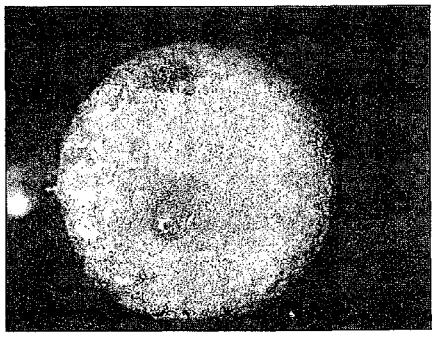
FIG. 6 shows surface conditions of a movable contact and a fixed contact after end of the durability test in the case where the gas charged pressure is at 0.5 atmosphere respectively.
Figure 6:
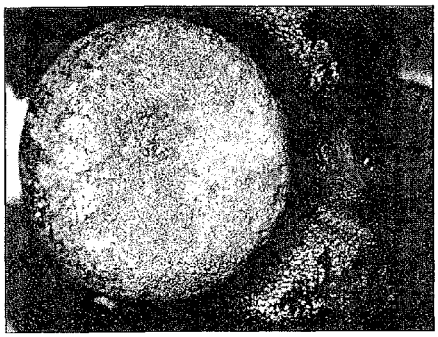
Figure 7:
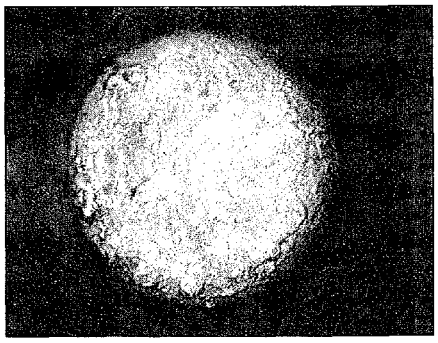
FIG. 7 is a view similar to FIG. 6 in the case where the gas charged pressure is at 0.7 atmosphere respectively.
Figure 7:
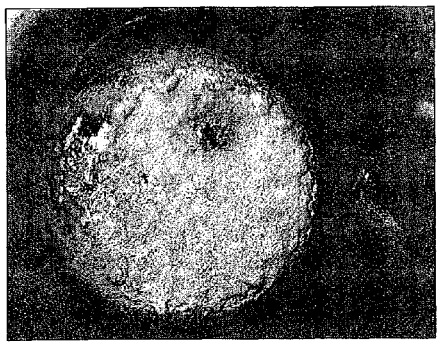
Figure 8:
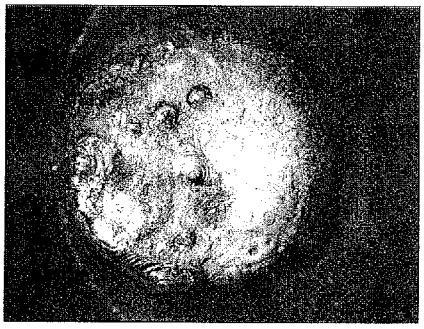
FIG. 8 is a view similar to FIG. 6 in the case where the gas charged pressure is at 1.0 atmosphere respectively.
Figure 8:
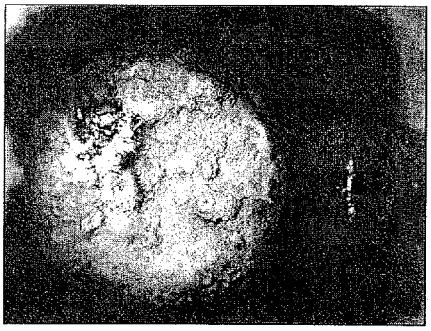
Figure 9:
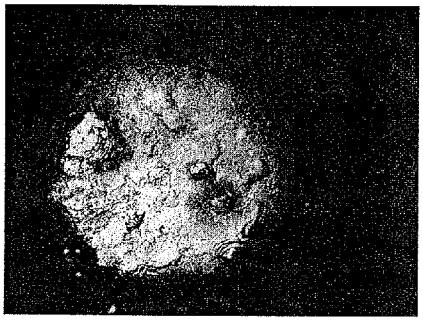
FIG. 9 is a view similar to FIG. 6 in the case where the gas charged pressure is at 1.3 atmosphere respectively.
Figure 9:
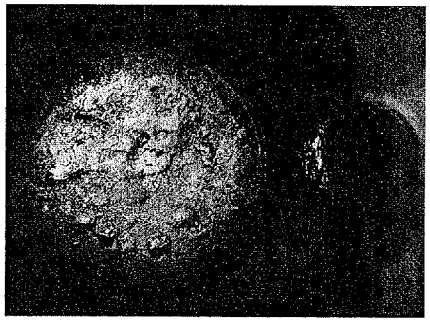
Figure 10:
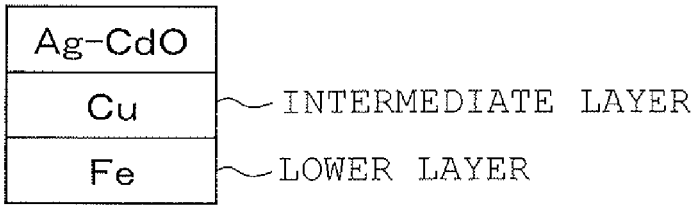
FIG. 10 is a graphical representation of a three layer structure contemplated for the movable and fixed contacts of the three responsive switch.

FIG. 5 shows the results of the durability test in the case where a pressure of gas charged into the hermetic container 2 was varied. An axis of abscissas designates pressure (atmospheric pressure (atm.)), and an axis of ordinates designates the number of switching operations counted before reach of contact welding. FIG. 5 shows measured values and an interpolation curve of the minimum values in a plurality of samples. A charged gas comprised 90% helium and 10% dried air. Each of the movable and fixed contacts 7 and 8 was a silver-cadmium oxide containing 15 weight percentage of cadmium oxide and had a three layer structure including an intermediate layer comprising copper and a lower layer comprising iron, the layers being deposited and pressed into a three layer structure together with the silver-cadmium oxide. Each contact was formed into the shape of a disc having a diameter of 4 mm and a thickness of 0.9 mm and had a contact surface formed into a spherical shape with a radius of 8 mm. An intercontact distance was 0.6 mm. The thermally responsive plate 6 was set to reverse its direction of curvature in an opening direction of the contacts 7 and 8 at the temperature of 155° C. and in a closing direction of the contacts 7 and 8 at the temperature of 90° C.

According to the test results as shown in FIG. 5, the number of switching operations was maximum (at or above 20000 times) at the pressure of about 0.5 atm. and was gradually reduced subsequently as the pressure was increased. The number of switching operations was about 18000 times (sampled minimum value) at 0.6 atm. and about 15000 times (sampled minimum value) at 0.68 atm. The number of switching operations was substantially constant at 10000 times (sampled minimum value) when the pressure exceeded 1 atm. On the other hand, when the pressure was reduced from about 0.5 atm., the number of switching operations was reduced at a slightly larger change rate than in the pressure increase. The number of switching operations was about 19000 times (sampled minimum value) at 0.45 atm. and about 15000 times (sampled minimum value) at 0.38 atm., being reduced to about 2000 times (sampled minimum value) at 0.1 atm.

More specifically, in the thermally responsive switch 1 with the above-described structure, at least 15000 times or above can be guaranteed as the number of switching operations when the charged pressure ranges from 0.38 atm. to 0.68 atm. as shown by alternate long and short dash line and arrow in FIG. 5. When the charged pressure ranges from 0.45 atm. to 0.6 atm., at least 18000 times or above can be guaranteed as the number of switching operations. Furthermore, at least 20000 times can be guaranteed as the number of switching operations when the charged pressure is 0.5 atm.

FIGS. 6, 7, 8 and 9 show the photographs of surfaces of the movable contact 7 (A-1 to A-4) and the fixed contact 8 (B-1 to B-4) after completion of the durability test when the charged pressure is at 0.5, 0.7, 1.0 and 1.3 atm. respectively. When the charged pressure is relatively higher as 1.0 atm. (FIG. 8) or 1.3 atm. (FIG. 9), arc stops at one portion of each contact. Accordingly, the surface of each contact is locally melted such that a protrusion is formed. It can be considered that the portion of the protrusion tends to be easily deposited such that the durability is reduced. On the other hand, when the charged pressure is relatively lower as 0.5 atm. (FIG. 6) or 0.7 atm. (FIG. 7), arc moves on each contact surface without stopping at one portion. As a result, it can be considered that the durability is improved since the contact surface is uniformly worn, the forming of the protrusion is suppressed and the contact welding is suppressed.

However, when the charged pressure is reduced such that arc is easier to move, there is a possibility that arc may move out of the gap between the contacts 7 and 8. When arc generated between the contacts 7 and 8 spreads to the thermally responsive element 6, the thermally responsive plate 6 is damaged such that the durability is rather reduced. Furthermore, insufficient breakdown voltage results in continuance of arc even at zero crossing of current. In this case, the durability is extremely lowered. An extreme reduction in the number of switching operations at the pressure of 0.1 atm. in FIG. 5 mainly arises from the above-described two reasons. Accordingly, an upper limit of the intercontact distance is set as a value that can prevent the transition of arc out of the contacts according to the reduction in the charged pressure. On the other hand, a lower limit of the intercontact distance is determined from the necessity to ensure the breakdown voltage. As the result of inspection of experimental results, it is preferable that the thermally responsive switch 1 of the embodiment has an intercontact distance ranging from 0.4 mm to 1.5 mm.

When the contacts 7 and 8 are opened, the movable contact side end of the thermally responsive plate 6 abuts against the inner surface of the housing 3 during the curvature direction reversing operation, so that further curvature direction reversing operation is limited. On the other hand, the thermally responsive switch 1 may be constructed so as to have an increased space between the inner surface of the housing 3 and an upper surface of the thermally responsive plate 6, whereupon the curvature direction reversing operation is prevented from being limited in the middle thereof. When the thermally responsive switch 1 is constructed as described above, the contacts 7 and 8 can be separated from each other with a longer distance therebetween by making use of a snap reversing force of the thermally responsive plate 6. Although this construction is regarded as effective for arc extinction, the thermally responsive plate 6 is easy to break unless the reversing operation thereof is limited, whereupon the durability thereof is extremely reduced. Accordingly, the aforesaid upper limit of the intercontact distance, 1.5 mm, is a value structurally set as a distance necessary for the movable contact side end of the thermally responsive plate 6 to abut against the inner surface of the housing 3 in the middle of the curvature direction reversing operation.

As described above, the thermally responsive switch 1 of the embodiment comprises the fixed contact 8 fixed to the conductive terminal pin 10A, the thermally responsive plate 6 reversing the direction of curvature according to the temperature, and the movable contact 7 secured to the free end of the thermally responsive plate 6, these components being enclosed in the hermetic container 2. Each of the movable and fixed contacts 7 and 8 comprises a silver-cadmium oxide system contact. The container 2 is filled with the gas containing helium (He) ranging from 50% to 95% so that the internal pressure of the container 2 ranges from 0.38 atm. to 0.68 atm. at room temperature or more preferably, from 0.45 atm. to 0.6 atm.

According to this construction, the arc generated during the opening of the contacts 7 and 8 moves on the contact surfaces such that the contact surfaces are uniformly worn. Accordingly, the durability can be improved since an occurrence of contact welding is suppressed. With this, the thermally responsive switch can cut off a larger current than the conventional thermally responsive switches, whereupon the current cutoff performance thereof can be improved. Furthermore, since the container 2 is filled with helium that has a good heat conductivity, the time period necessitated for the opening of the contacts 7 and 8 upon the flow of an excessively large current such as the constraint current can be shortened (or increased depending upon the construction) and a rated working current value can be increased. Furthermore, since each of the contacts 7 and 8 contains 5 to 15 weight percent cadmium oxide, the welding force is rendered further smaller and wear due to arc is further reduced. An influence of the helium charged rate upon the durability of the switch is relatively smaller.

In this case, a breakdown voltage can be ensured in the use of a commercial power supply since the intercontact distance is set at or above 0.4 mm. Furthermore, since the intercontact distance is set at a value equal to or smaller than 1.5 mm, arc can be prevented from spreading out of the gap between the contacts 7 and 8 as much as possible, and the reduction in the durability can be prevented by suppressing damage due to arc to peripheral components such as the thermally responsive plate 6. Furthermore, when the intercontact distance is set at a value equal to or smaller than 1.5 mm, the movable-contact side end of the thermally responsive plate 6 abuts against the inner surface of the housing 3 in the middle of the contact opening operation. This can prevent an excessive displacement of the thermally responsive plate 6 by the snap curvature direction reversing operation and subsequent occurrence of vibration, whereupon reduction in the durability can be prevented.

The disc having the diameter ranging from 3 mm to 5 mm is used as each of the movable and fixed contacts 7 and 8. The durability of each contact against the heat due to arc is improved when the size of each contact is increased. However, since a main material of each contact is silver, costs are increased considerably. In contrast, when the size of each contact is small, each contact with a reduced size is advantageous in cost reduction. However, it is experimentally confirmed that each contact with the diameter of 3 mm at the smallest is necessitated in order that the durability performance against current of 60 A may be ensured. Thus, using each contact with the diameter equal to or larger than 5 mm, for example, with the diameter of 6 mm is possible and improves the durability. However, such contact is impractical from the viewpoints of costs and the size of the thermally responsive switch.

Since each of the movable and fixed contacts 7 and 8 has a convexly curved surface, arc is generated more easily on the central part of each of the contacts 7 and 8, and arc transition out of the gap between the contacts is suppressed. Thus, the durability and current cutoff performance of the thermally responsive switch 1 are improved without rendering the contacts 7 and 8 and the thermally responsive plate 6 larger in size. Consequently, the thermally responsive switch 1 can easily be housed in the hermetic housing of the compressor motor and is accordingly suitable for a thermal protector for the compressor motor.

The invention should not be limited by the above-described embodiment. The embodiment may be modified as follows, for example. The hermetic container 2 is filled with the gas containing helium ranging from 50% to 95% so that an internal pressure of the container 2 ranges from 0.38 atm. to 0.68 atm. at room temperature. Although this is an indispensable feature, the intercontact distance, the shape and size of the contacts 7 and 8 should not be limited by the above-described numerical ranges.

The shape of the hermetic container 2 should not be limited to the elongate dome shape. For example, when a certain strength can be achieved by providing ribs along the lengthwise direction of the hermetic container 2, the shape of the hermetic container 2 may or may not be the elongate dome shape. Although the support 5 is fixed to one end of the hermetic container 2, the thermally responsive plate 6 may be fixed in the vicinity of the center of the hermetic container 2 when the thermally responsive switch is rendered further smaller. The support 5 may have a button shape and may be eliminated.

The heater 12 and the heat-resistant inorganic insulating member 13 may be provided as occasion demands. Although the header plate 4 is provided with two terminal pins 10A and 10B, only one terminal pin may be provided and the metal header plate 4 may serve as the other terminal.

Two or more pairs of switching contacts 7 and 8 may be provided. At least one of the movable and fixed contacts 7 and 8 may have a convexly curved surface. Furthermore, a flat portion may be provided on a top of the convexly curved surface.

The motor for which the thermally responsive switch is used as the thermal protector should not be limited to the single-phase induction motor but may include three-phase induction motors. Furthermore, the thermally responsive switch 1 may be applied to other types of electric motors, for example, motors to which AC voltage is applied, such as synchronous motors.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

The invention claimed is:

1. A thermally responsive switch which is used to cut off AC current flowing through a compressor motor, the thermally responsive switch comprising:

a hermetically sealed container including a metal housing and a header plate hermetically secured to an open end of the housing;

at least one conductive terminal pin inserted through a through hole formed through the header plate and hermetically fixed in the through hole by an electrically insulating filler;

a fixed contact fixed to the terminal pin in the container;

a thermally responsive plate having one of two ends conductively connected and fixed via a support made of a metal plate to an inner surface of the container and formed into a dish shape by drawing so as to reverse a direction of curvature at a predetermined temperature;

at least one movable contact electrically conductively secured directly to the other end of the thermally responsive plate and constituting at least one pair of switching contacts together with the fixed contact, wherein each of the fixed contact and the movable contact comprises a silver-cadmium oxide system contact, wherein the container is filled with a gas containing helium ranging from 50% to 95% so that an internal pressure of the container ranges from 0.38 atmosphere to 0.68 atmosphere at room temperature, wherein an intercontact distance between the contacts ranges from 0.4 mm to 1.5 mm, wherein each contact has a minimum diameter ranging from 3 mm to 5 mm, and wherein a switching operation ranges from 15,000 times to 20,000 times when a durability test in which an energized state and a substantially two-minute de-energized state are repeated alternately is conducted under following conditions:

(a) a power supply of 240 V 50 Hz is applied to the compressor motor in a locked state so that a locked-rotor current of 49 A is caused to flow into the compressor motor, (b) the gas in the container is filled with 90%-helium and 10%-dried air, (c) each of the movable and fixed contacts comprises a three layer structure including an upper layer comprising the silver-cadmium oxide system contact with 15 weight percentage of metal oxide, an intermediate layer comprising copper and a lower layer comprising iron, is formed into a disc shape with a diameter of 4 mm and a thickness of 0.9 mm and has a contact surface formed into a spherical shape with a radius of 8 mm and an intercontact distance of 0.6 mm in an open state, and (d) the thermally responsive plate is set to reverse its direction of curvature in a contact opening direction at 155° C. and in a contact closing direction at 90° C.

2. The thermally responsive switch according to claim 1, wherein the container is filled with the gas so that the internal pressure of the container ranges from 0.45 atmosphere to 0.6 atmosphere at room temperature.

3. The thermally responsive switch according to claim 2, wherein the movable contact and the fixed contact have an intercontact distance therebetween set at or above 0.4 mm so that the thermally responsive plate abuts against the inner surface of the container during a contact opening operation and so that a subsequent operation of the thermally responsive plate is limited during a curvature direction reversing operation.

4. The thermally responsive switch according to claim 3, wherein each of the fixed contact and the movable contact is formed into a disc shape having a diameter ranging from 3 mm to 5 mm.

5. The thermally responsive switch according to claim 4, wherein at least one of the fixed contact and the movable contact has a convexly curved surface.

6. The thermally responsive switch according to claim 3, wherein the intermediate and lower layers are stacked and pressure-bonded together.

7. The thermally responsive switch according to claim 2, wherein each of the fixed contact and the movable contact is formed into a disc shape having a diameter ranging from 3 mm to 5 mm.

8. The thermally responsive switch according to claim 7, wherein at least one of the fixed contact and the movable contact has a convexly curved surface.

9. The thermally responsive switch accordingly to claim 2, wherein the intermediate and lower layers are stacked and pressure-bonded together.

10. The thermally responsive switch according to claim 1, wherein the movable contact and the fixed contact have an intercontact distance therebetween set at or above 0.4 mm so that the thermally responsive plate abuts against the inner surface of the container during a contact opening operation and so that a subsequent operation of the thermally responsive plate is limited during a curvature direction reversing operation.

11. The thermally responsive switch according to claim 10, wherein each of the fixed contact and the movable contact is formed into a disc shape having a diameter ranging from 3 mm to 5 mm.

12. The thermally responsive switch according to claim 11, wherein at least one of the fixed contact and the movable contact has a convexly curved surface.

13. The thermally responsive switch according to claim 10, wherein the intermediate and lower layers are stacked and pressure-bonded together.

14. The thermally responsive switch according to claim 1, wherein each of the fixed contact and the movable contact is formed into a disc shape having a diameter ranging from 3 mm to 5 mm.

15. The thermally responsive switch according to claim 14, wherein at least one of the fixed contact and the movable contact has a convexly curved surface.

16. The thermally responsive switch according to claim 1, wherein the intermediate and lower layers are stacked and pressure-bonded together.

17. The thermally responsive switch of claim 1, wherein a remainder of the gas contains one or more of nitrogen, dried air and carbon dioxide.

18. The thermally responsive switch of claim 1, wherein the thermally responsive switch is in use of a commercial power supply ranging from AC 100 V to 260 V.

* * * * *